US005606401A

United States Patent [19]

Yano

[11] Patent Number: 5,606,401

[45] Date of Patent: Feb. 25, 1997

[54] CHARGING DEVICE INCLUDING MOVABLE CHARGING BRUSH CONTACTABLE TO MEMBER TO BE CHARGED, AND IMAGE FORMING APPARATUS USING SAME

[75] Inventor: Hideyuki Yano, Yokohama, Japan

[73] Assignee: Canon Kabushiki Kaisha, Tokyo, Japan

[21] Appl. No.: 559,180

[22] Filed: Nov. 13, 1995

Related U.S. Application Data

[63] Continuation of Ser. No. 203,408, Mar. 1, 1994.

[30] Foreign Application Priority Data

Mar. 1, 1993 [JP] Japan ..... 5-066150
Feb. 24, 1994 [JP] Japan ..... 6-026811

[51] Int. Cl.[6] ..... G03G 15/02

[52] U.S. Cl. ..... 355/219; 361/221

[58] Field of Search ..... 355/219; 361/221, 361/225

[56] References Cited

U.S. PATENT DOCUMENTS

| | | | |
|---|---|---|---|
| 4,555,171 | 11/1985 | Clouthier et al. | 361/225 X |
| 4,761,709 | 8/1988 | Ewing et al. | 361/225 |
| 5,305,061 | 4/1994 | Takama et al. | 355/219 |
| 5,351,109 | 9/1994 | Haneda | 355/219 |
| 5,357,323 | 10/1994 | Haneda et al. | 355/219 |

FOREIGN PATENT DOCUMENTS

| | | | |
|---|---|---|---|
| 0510643 | 10/1992 | European Pat. Off. . | |
| 51-57958 | 5/1976 | Japan . | |
| 59-229571 | 12/1984 | Japan . | |
| 63-149669 | 6/1988 | Japan . | |
| 63-187267 | 8/1988 | Japan | 355/219 |
| 5-134517 | 5/1993 | Japan | 355/219 |

OTHER PUBLICATIONS

Patent Abstracts of Japan, vol. 9, No. 105 (P–354), May 9, 1985. (Publication No. 59–229571).
European Search Report.

*Primary Examiner*—William J. Royer
*Attorney, Agent, or Firm*—Fitzpatrick, Cella, Harper & Scinto

[57] ABSTRACT

A charging device includes a movable member to be charged having a surface charge injection layer with a volume resistivity of $1\times10^{10}$–$1\times10^{14}$ Ωcm, and a charging member for charging the member to be charged, the charging member including a movable charging brush contactable with the member to be charged and supplied with a voltage. The movable member is driven such that the following relationship is satisfied, $N(Vk-Vb)/Vk>4$, where Vk (mm/sec) is a movement speed of the surface of the member to be charged, Vb (mm/sec) is a movement speed of an outer peripheral surface of the charging brush, and N (mm) is a contact width between the member to be charged and the charging brush, measured in a movement direction of the member to be charged. The charging member may include a movable conductive particle layer instead of a charging brush.

50 Claims, 6 Drawing Sheets

CHARGING DEVICE INCLUDING MOVABLE CHARGING BRUSH CONTACTABLE TO MEMBER TO BE CHARGED, AND IMAGE FORMING APPARATUS USING SAME

This application is a continuation of application Ser. No. 08/203,408 filed Mar. 1, 1994.

BACKGROUND OF THE INVENTION

Field Of The Invention And Related Art

The present invention relates to a charging device for charging (or discharging) a member to be charged or discharged, and more particularly to a contact type charging device (contact charging device or direct charging device) having a charging member contacted to the member to be charged and supplied with a voltage in use. The present invention also relates to a process cartridge and an image forming apparatus such as a copying machine or printer of an electrophotographic type or electrostatic recording type in which a charging member supplied with a voltage is contacted to an image bearing member to charge or discharge the imagebearing member in an image forming process.

The description of a conventional image forming apparatus for example, will be made for convenience of explanation.

Heretofore, in an image forming apparatus of an electrophotographic type or electrostatic recording type, a corona charger has been widely used to charge an image bearing member in the form of an electrophotographic photosensitive member or an electrostatic recording dielectric member or the like.

Recently, however, from the standpoint of the advantages of low ozone production or low electric power consumption or the like, a contact charging device having a charging member contacted to the member to be charged and supplied with a voltage, has been put into practice. Particularly, a roller type-charging device is preferably used because of the advantage of its stability.

In the contact type charging device of the roller charging type, an electroconductive elastic roller (charging member) is press-contacted to the member to be charged and is supplied with a voltage to charge it.

More particularly, charging is effected by electric discharge from the charging member to the member to be charged, and therefore, the charging action starts with a voltage at a threshold level.

For example, when the charging roller is press-contacted to an OPC photosensitive member having a thickness of 25 μm (member to be charged), the surface potential of the photosensitive member starts to increase when a voltage not less than approx. 640 V is applied to the charging roller. Subsequently, the surface potential of the photosensitive member increases linearly with an inclination I relative to the applied voltage. Hereinafter, the threshold voltage is defined as a charge starting voltage Vth. Thus, in order to obtain a surface potential Vd of the photosensitive member required for an electrophotographic process, a DC voltage not less than Vd+Vth is required to be supplied on the charging roller. This is called a DC charging process since only a DC voltage is applied to the contact charging member.

However, it has been difficult to provide a predetermined potential level on the photosensitive member because the resistance of the contact charging member changes with variations in the ambient conditions, and because the film thickness of the photosensitive layer (member to be charged) is scraped which results in variations in the film thickness, which leads to variations in the threshold voltage Vth.

Japanese Laid-Open Patent Application No. 149669/1988 discloses, as a measure for providing more uniform charging, an AC charging system, in which an oscillating voltage includes a DC component corresponding to the desired Vd and an AC component having a peak-to-peak voltage not less than twice as high as the threshold voltage Vth. This is advantageous in that a potential uniforming effect by the AC is expected, and the potential of the member to be charged converges to the voltage Vd which is the center between the peaks of the AC voltage, and is not disturbed by any ambient condition change.

However, even is such a contact type charging device, the essential charging mechanism is based on the electric discharge from the charging member to the member to be charged, and therefore, the voltage required for charging has to be not lower than the surface potential of the member to be charged, which results in a small amount of ozone production.

When an AC charging system is used to provide uniform charging, noise (AC charging noise) produced by vibrations in the charging member and the member to be charged by the AC electric field, and deterioration of the surface to be charged by the discharging, are increased, which introduces new problems. Therefore, direct injection charging into the member to be charged, has been desired.

Contact injection charging, in which a voltage applied to a contact electroconductive member in the form of a charging roller, a charging brush, a charging magnetic brush or the like, is applied to inject electric charge to the trap level in the surface of the member to be charged, has been disclosed (see, e.g., "Contact charging property using electroconductive roller," *Japan Hardcopy* (1992, p. 287). In these methods, a photosensitive member (member to be charged) having an electrically insulative property in the dark is contact-charged by a low resistance charging member supplied with a voltage, and therefore, it is a premise that the resistance of the charging member is sufficiently low, that the material for imparting the electroconductivity to the charging member (conductive filler or the like) is sufficiently exposed at the surface.

Japanese Laid-Open Patent Application No. 57958/1976 discloses that a photosensitive member having a protection film in which conductive particles are dispersed, is electrically charged using conductive fine particles.

When direct injection charging is effected to the photosensitive member, it is required that the charging member and the surface of the photosensitive member are directly contacted ohmicly to permit transfer of electric charge therebetween, as contrasted to the conventional charging mechanisms using discharge. In other words, close contact between the charging member and the photosensitive member is required over the entire surfaces thereof, so that microscopic uncharged portions do not result.

In a conventional contact type charging system, the charging mechanism is based on electric description of the preferred embodiments of the present invention taken in conjunction with the accompanying drawings.

DESCRIPTION OF THE PREFERRED EMBODIMENTS (1) Image Forming Apparatus

Figure 1:
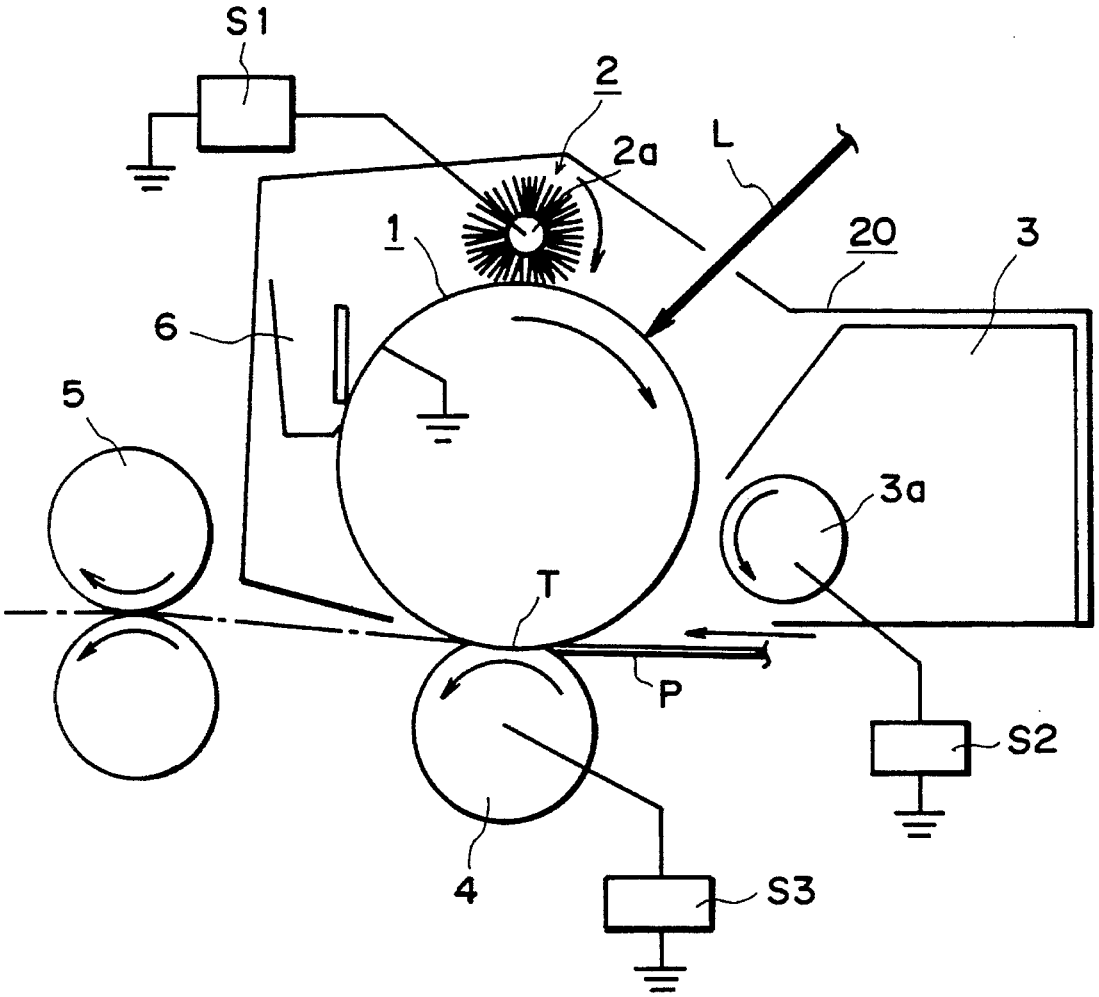
FIG. 1 is a sectional view of an example of an image forming apparatus.

FIG. 1 is a sectional view of an exemplary image forming apparatus in the form of a laser beam printer of an image transfer and electrophotographic type.

It comprises an electrophotographic photosensitive member in the form of a rotatable drum as an image bearing member 1. It is an OPC photoconductive member having a diameter of 30 mm in this embodiment. It is rotated in the direction indicated by an arrow at a process speed (peripheral speed) of 100 mm/sec.

It also comprises a rotatable brush roller (charging brush) 2 as the contact charging member, which is contacted to the photosensitive member 1. The rotatable charging brush 2 is supplied with a DC bias voltage of −700 V from a charging bias supplying voltage source S1 so as to substantially uniformly charge the outer peripheral surface of the rotating photosensitive member 1 to −680 V.

The surface of the rotating photosensitive member 1 thus charged is exposed to a scanning laser beam L which has been modulated in the intensity thereof in accordance with a time series electric digital pixel signal indicative of image information supplied from a laser beam scanner (unshown), including a laser diode, and a polygonal mirror or the like, by which an electrostatic latent image is formed in accordance with predetermined image information on the peripheral surface of the photosensitive member.

The electrostatic latent image is reverse-developed into a toner image by a reverse developing device 3 using magnetic one component insulating negative toner. Designated by a reference 3*a* is a non-magnetic sleeve having a diameter of 16 mm, and containing a magnet. A negative toner is applied onto the developing sleeve, and the sleeve is rotated at the same speed as the photosensitive member, while the gap between the surface of the photosensitive member 1 is fixed to be 300 μm. The sleeve 3*a* is supplied with a developing bias voltage from a developing bias source S2. The voltage is in the form of a DC biased AC voltage containing a DC voltage component of −500 V and an AC voltage component in the form of a rectangular wave having a frequency of 1800 Hz and a peak-to-peak voltage of 1600 V, so that a so-called jumping development is carried out between the sleeve 3*a* and the photosensitive member 1.

On the other hand, a transfer material P as a recording material is supplied from a sheet feeding station (unshown), and it is introduced into a nip (transfer station) T formed between the photosensitive member 1 and an intermediate resistance transfer roller 4 (contact transfer means) press-contacted thereto with a predetermined pressure, at a predetermined timing. The transfer roller 4 is supplied with a predetermined transfer bias voltage from a transfer bias voltage application source S3.

In this embodiment, the transfer roller 4 has a roller resistance of $5\times10^8\Omega$, and is supplied with a DC voltage of +2000 V.

The transfer material P introduced into the transfer station is passed through the transfer nip T, by which the toner image is sequentially transferred from the surface of the rotating photosensitive member 1 onto the surface of the transfer material P by electrostatic force and mechanical pressure force.

The transfer material P now having a toner image is separated from the surface of the photosensitive member 1 and is introduced into an image fixing device 5, e.g., of a thermal fixing type. The toner image is fixed thereby, and is discharged to the outside of the apparatus as a print, a copy, or the like.

The surface of the photosensitive member, after the toner image has been transferred onto the transfer material P, is cleaned by a cleaning device 6, so that any deposited contamination, such as residual toner or the like, is removed so as to be prepared for repeated image forming operation.

The image forming apparatus of this embodiment is usable with a detachably mountable cartridge. The cartridge 20 contains four process means elements, namely, the photosensitive member 1, the contact charging member 2, the developing device 3, and the cleaning device 6, in this embodiment.

(2) Photosensitive Member 1

In the present embodiment, the electrophotographic photosensitive member 1 (the member to be charged) is in the form of an OPC photosensitive member having a negative charging property. It comprises a drum base made of aluminum, which is electrically conductive, which is electrically grounded, which has a diameter of 30 mm, and which has five functional layers, namely, first, second, third, fourth and fifth layers from the bottom.

The first layer is a lining layer which is effective to neutralize defects in the aluminum base drum and to prevent production of moire due to reflection of the laser beam. It is an electroconductive layer having a thickness of approx. 20 μm.

The second layer is a positive charge injection preventing layer and is effective to prevent positive charge injected from the aluminum base from neutralizing the negative charge applied to the surface of the photosensitive member. It is an intermediate resistance layer having a thickness of approx. 1 μm, and having a resistance adjusted to be $10^6$ Ωcm by amyran resin and methoxymethyl nylon.

The third layer is a charge generating layer of disazo dye dispersed in resin material having a thickness of approx. 0.3 μm, and couples positive and negative electric charges upon being disposed to laser light.

The fourth layer is a charge transfer layer and comprises hydrazone dispersed in polycarbonate resin. It is a p-type semiconductor. Therefore, the negative electric charge on the surface of the photosensitive member is unable to move to this layer, and only positive charge generated in the charge generating layer is transferred to the surface of the photosensitive member.

The fifth layer is a charge injection layer which is one of the features of the present invention, and is formed by applying ultra fine particles dispersed in a binder (light curing acrylic resin). The fine particles are $SnO_2$ having a particle size of approx. 0.03 μm, and are given a low resistance (electroconductivity) by doping with antimon (light transmitting electroconductive filler). In the acrylic resin, 70% by weight of such $SnO_2$ particles are dispersed.

In order to provide a sufficient charging property and in order to prevent "flow" of an image, the resistance of the charge injection layer is preferably $1\times10^{10}$–$1\times10^{14}$ Ωcm. To accomplish this, the content of $SnO_2$ is preferably 2–100% by weight on the basis of the weight of the binder.

Such liquid is applied, as the charge injection layer, to a thickness of approx. 3 μm through a dipping process, spray process, roll coating process, beam coating process or the like.

The binder of the charge injection layer may be the same as the binder material of the charge transfer layer. However, in such a case, the coating method should be properly selected so as to avoid disturbance of the applied charge transfer layer at the time of the application of the charge injection layer. By the above process, the surface resistance of the photosensitive layer is reduced to $1\times10^{11}$ Ωcm from $1\times10^{15}$ Ωcm (in the case of a charge transfer layer alone).

(3) Contact Charging Member 2

The charging brush 2 (contact charging member) of this embodiment is in the form of a roll brush having an outer diameter of 14 mm. It has been produced by helically rolling electroconductive rayon fiber REC-C (pile fabric available from YUNICHIKA Kabushiki Kaisha, Japan) in the form of a tape on a metal core 2*a* having a diameter of 6 mm. The diameter of the fiber is 30 μm, and the fiber density is 160 fibers/mm$^2$. The resistance of the brush is $1\times10^5$Ω. The resistance has been obtained from the electric current when 100 V is applied, and the brush is contacted to a metal drum of 30 mm dia. with a nip width of 3 mm.

By using a charging brush 2 of this resistance, excessive leak current through a pin hole or the like in the photosensitive member, if any, can be prevented.

(4) Charging Mechanism

In this embodiment, electric charge is injected into the surface of the photosensitive member (member to be charged) having an intermediate surface resistance, by an intermediate resistance contact charging member 2. In this embodiment, electric charge is not injected to the trap potential of the material of the surface of the photosensitive member, but conductive particles in the charge injection layer are electrically charged.

Figure 2A:
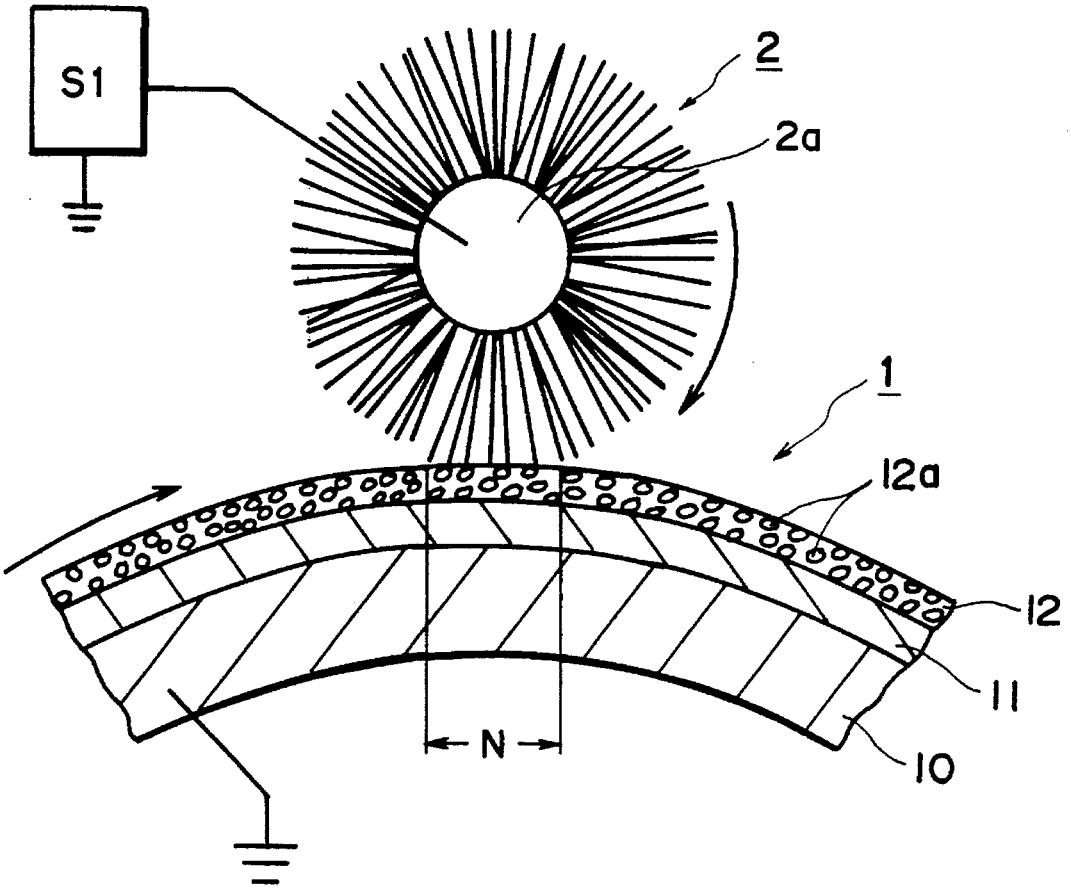
FIG. 2A is an enlarged view of a contact charging member in the form of a charging brush.
Figure 2B:
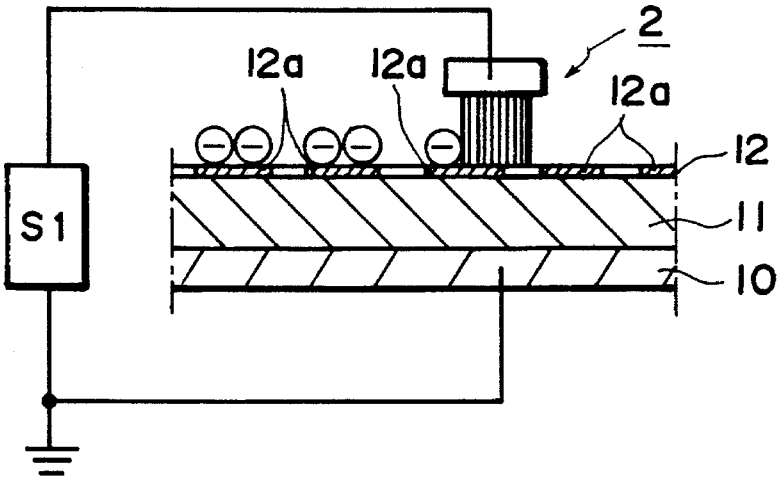
FIG. 2B is an equivalent circuit diagram of the structure shown in FIG. 2A.

More particularly, as shown in an enlarged view of the charging brush (FIG. 2A), and an equivalent model (FIG. 2B), a fine capacitor constituted by the charge transfer layer 11 of the photosensitive member 1 as a dielectric material, and aluminum base 10 and conductive particles 12*a* in the charge injection layer 12 as opposite electrodes, is electrically charged by the contact charging member 2.

The conductive particles 12*a* are electrically independent, and constitute a kind of fine float electrodes. Therefore, the surface of the photosensitive member macroscopically looks like it is charged to a uniform potential, but actually a great number of fine charged $SnO_2$ particles 12*a* cover the surface of the photosensitive member. Since the $SnO_2$ particles 12*a* are electrically independent, the electrostatic latent image can be retained when the image exposure is effected by the laser beam.

According to this embodiment, the trap level which previously has existed on the surface of a conventional photosensitive member (although the amount is not large), is substituted by $SnO_2$ particles. This is why the charge injection property and charge retaining property has been improved.

When a conventional photosensitive member is to be properly charged by charge injection, the electric charge has to be injected efficiently into a small number of trap points. Accordingly the resistance of the charging member 2 has to be not more than $1\times10^3$Ω. The resistance of the ordinary material of the surface of the photosensitive member is approx. $1\times10^{15}$ cm.

Where a charge injection layer 12 is provided, the area capable of retaining electric charge on the surface of the photosensitive member increases, and therefore, good charging is possible even if a higher resistance charging member 2 is used.

Actually, if the resistance of the charge injection layer 12 is $1\times10^{10}$–$1\times10^{14}$ Ωcm, then charging is possible with such a high efficiency that the charge potential of the surface of the photosensitive member is not less than 90% of the applied voltage, even if the charging member has a resistance of $1\times10^7$Ω.

On the other hand, it has been empirically confirmed that when the resistance of the charging member 2 is not less than $1\times10^4$ Ωcm in order that despite the existence of a pin hole in the surface of the photosensitive member the leakage does not occur, that the photosensitive member 1 and the charging member 2 are not damaged or that improper charging of the entirety of the contact portion due to the voltage drop because of the leakage current, does not occur. In addition, there is a problem that the developing operation is improper in the developing position if a fiber of the brush (charging member) is removed and deposited on the photosensitive member or if a conductive particle (charging member) is removed and deposited on the photosensitive member. To avoid this problem, the charging member preferably has a resistance of not less than $1\times10^4$Ω. As a result of experiments by the inventors, it has been confirmed that a charging system providing satisfactory charge injection property and exhibiting satisfactory resistance against pin hole effect can be constituted if a photosensitive member 1 having a charge injection layer 12 having a resistance of $1\times10^{10}$–$1\times10^{14}$ Ωcm is charged by a contact charging member 2 having a resistance of $1\times10^4$–$1\times10^7$Ω.

The following is a Table of the results of experiments.

TABLE 1

| DRUM RESISTANCE CHARGER RESISTANCE | $1\times10^8$ Ωcm WITH C.I. LAYER | $1\times10^{10}$ Ωcm WITH C.I. LAYER | $1\times10^{14}$ Ωcm WITH C.I. LAYER | $1\times10^{15}$ Ωcm WITH C.I. LAYER |
|---|---|---|---|---|
| $1\times10^2$ Ω | IMAGE FLOW/ LEAK | LEAK | LEAK | LEAK |

TABLE 1-continued

| DRUM RESISTANCE CHARGER RESISTANCE | $1 \times 10^8$ Ωcm WITH C.I. LAYER | $1 \times 10^{10}$ Ωcm WITH C.I. LAYER | $1 \times 10^{14}$ Ωcm WITH C.I. LAYER | $1 \times 10^{15}$ Ωcm WITH C.I. LAYER |
|---|---|---|---|---|
| $1 \times 10^3$ Ω | IMAGE FLOW/ LEAK | LEAK | LEAK | LEAK |
| $1 \times 10^5$ Ω | IMAGE FLOW | G | G | IMPROPER CHARGING |
| $1 \times 10^8$ Ω | IMAGE FLOW | IMPROPER CHARGING | IMPROPER CHARGING | IMPROPER CHARGING |

In the Table, "LEAK" means that leakage occurs when a pin hole exists in the photosensitive member although charging is possible; "IMAGE FLOW" means that the charge retaining property of the photosensitive member is low, and therefore, the surface potential of the photosensitive member is not high enough; and "G" means good results.

As described hereinbefore, in this embodiment, a charging brush 2 supplied with a DC voltage of −700 V is contacted to the photosensitive member 1 and is rotated.

Figure 3:
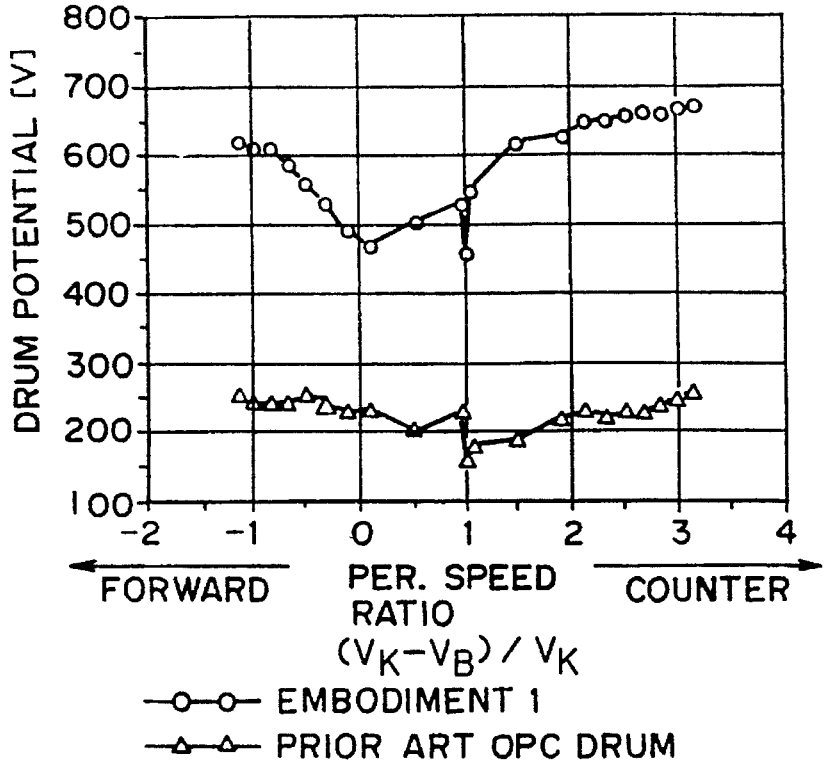
FIG. 3 is a graph illustrating the converging property of the charge potential and the moving speed of the contact charging member.

As described in the foregoing, charging is effected by charge injection from the charging brush 2 to the $SnO_2$ particles 12*a* on the surface of the photosensitive member 1, and therefore, it is desired that the charging brush 2 is contacted to every part of the entire surface of the photosensitive member. The charging brush 2 was contacted to the photosensitive member to form a contact nip width N of 2 mm (width measured in the movement direction of the surface of the photosensitive member), and the number of rotations per unit time of the charging brush 2 was changed, and the charging efficiency was measured. The results are shown in FIG. 3.

The potential of the photosensitive member surface was first reduced to 0 V, and the potential was the one provided when a part of the photosensitive member passed by the charging brush 2 (nip N) once.

Here, a peripheral speed ratio is defined as:

$$(Vk-Vb)/Vk$$

where Vk is a peripheral speed of the photosensitive member (mm/sec), and VB is a peripheral speed of the charging brush (mm/sec).

It has been found that the charging efficiency is dependent on the peripheral speed ration and that a satisfactory potential converging property can be provided if the peripheral speed ratio is not less than 2. A peripheral speed ratio of 2 means that the charging brush 2 is rotated at the same peripheral speed as the photosensitive member 1 in the opposite peripheral movement direction (Vb=−Vk). Therefore, experiments were carried out with this condition.

The peripheral speed ratio is effective to assure sufficient charging time and to increase the chance of contact between any part of the photosensitive member 1 and the charging brush 2. If the charging nip width N is further increased, then satisfactory charging is possible even if the peripheral speed ratio is reduced.

From the foregoing, the peripheral speed ratio multiplied by the charging nip width N, that is, N(Vk−Vb)/Vk is closely related to the charging efficiency. It has been found that good charging efficiency (i.e., a charged potential of not less than 90% of the applied voltage) can be achieved if this value is not less than 4 mm.

Experiments have been carried out with a charging nip width N of 2 mm and 3 mm. A peripheral speed ratio of not less than 2 was required to provide 90% efficiency, when the charging nip width N=2 mm, but when the charging nip width N=3 mm, the same efficiency charging was possible with a peripheral speed ration of 1.3.

As will be understood from FIG. 3, charging is most difficult when the peripheral speed ratio is 0, because the chance of contact between any point of the photosensitive member 1 and the contact charging member 2 is the least when the peripheral speed ratio is 0. For efficient charge injecting charging, the peripheral speed ratio (or peripheral speed difference ratio) is not 0.

Figure 4:
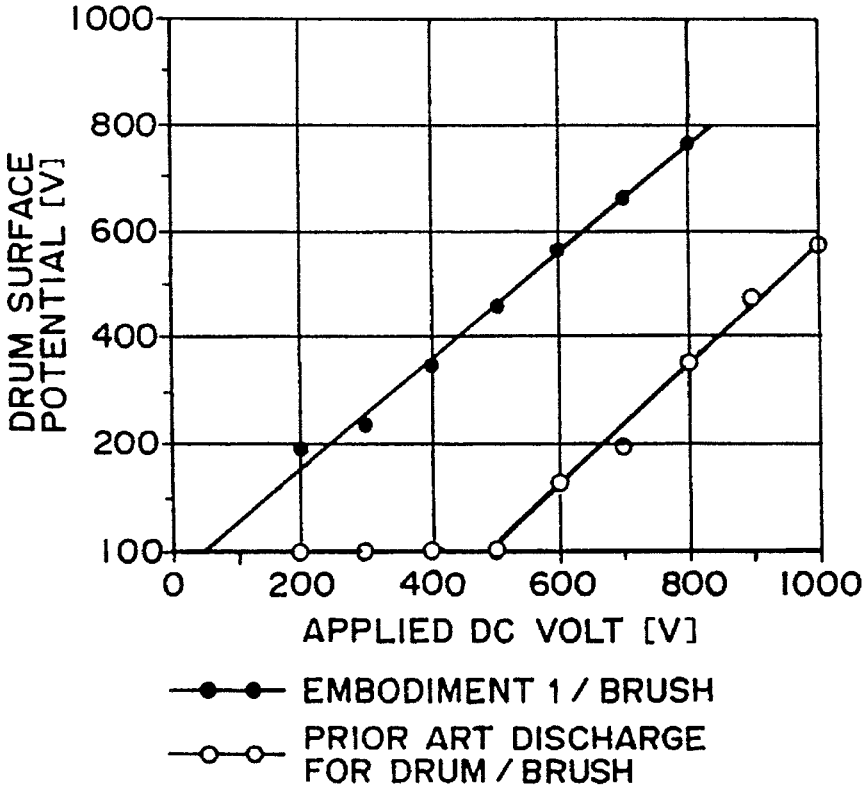
FIG. 4 is a graph illustrating a relationship between the charge potential and the voltage applied to the contact charging member.

In this state, as shown in FIG. 4, the voltage applied to the charging brush 2 and the surface potential of the photosensitive member 1 is in a linear relationship without the existence of the conventional discharge threshold level. It has been confirmed that injection charge occurs.

From FIG. 4, it is understood that charge injection does not easily occur when a conventional photosensitive drum is used with the existence of the discharge threshold. In addition, as shown in FIG. 3, it is apparent that the conventional photosensitive drum shows poor potential converging property.

In this manner, the photosensitive member is charged to −680 V with the charging brush 2 supplied with −700 V.

(5) Transfer Means 4

With a conventionally used transfer means in the form of a corona charger, the positive transfer memory in the photosensitive member in the case of reverse development is relatively small. In reverse development, the charge polarity of the latent image formed on the photosensitive member and the polarity of the transfer voltage applied to the transfer member, are opposite from each other, and the polarity of the primary charging is negative. However, when a contact transfer means 4 (transfer roller or the like) is used for the purpose of reducing ozone production, electric discharge occurs between the contact transfer member 4 and the photosensitive member 1, and therefore, positive memory tends to occur.

When a conventional contact charging member is used for primary charging with the above-described contact transfer means, local improper charging due to positive memory is unavoidable because the charging zone of the contact charging device is small as compared with a conventional corona charging device. Therefore, the necessity arises for optimizing the resistance of the transfer roller or for complicated control of the transfer bias voltage or the like.

The mechanism for production of positive memory is as follows. First, a positive charge provided by the transfer charger moves into the photosensitive member, but does not penetrate to the conductive base of the photosensitive member, so that it stagnates in the charge transfer layer. Even if the surface of the photosensitive member is uniformly charged to a negative potential by a subsequent primary charging operation, the positive charge stagnated in the photosensitive member moves back to the surface to neutralize the negative charge, thus resulting in local improper charging.

However, when the photosensitive member 1 is provided with a charge injection layer 12 as in this embodiment, positive memory does not easily occur. This is because positive memory provided by the transfer charger does not move into the photosensitive member but is retained in the charge injection layer, and therefore, the positive charge is quickly neutralized by a subsequent primary charging operation, so that the photosensitive member is uniformly charged to a negative polarity.

This effect is remarkable, particularly when the charge retentivity is low, because of the low resistance of the charging member 2, or because of a narrow charging zone or the like. Therefore, the provision of a charge injection layer is significantly effective when a transfer roller 4 is used.

Therefore, in the case of an electrophotographic apparatus using a contact transfer member such as transfer roller 4, the resistance of the charging member 2 is preferably $1\times10^4$–$1\times10^7\Omega$, as described hereinbefore, also from the standpoint of preventing positive memory. If the charging member 2 has a resistance of not less than $1\times10^7$, then local improper charging due to positive memory is remarkable.

A description will be made as to the density of the brush fibers (charging member).

In the case of direct charge injection into the photosensitive member, ohmic direct contact is desired between the photosensitive member surface and the charging member for injecting the charge to the $SnO_2$ particles in the surface of the photosensitive member, as described hereinbefore. This is because close contact between the charging member and the photosensitive member is desired to prevent occurrence of microscopic non-charged portions.

In order to assure microscopic contact between the charging member and the photosensitive member, the following methods are preferable. The nip width therebetween is enlarged; a peripheral speed difference is provided between the charging member and the photosensitive member so that any point on the photosensitive member can be contacted by the charging member more frequently; when the charging member is a fur brush, the density of the fibers constituting the brush is increased; or when a magnetic brush is used, the particle size of the magnetic particles is reduced. These are all for compensating for the occurrence of non-contact portions between the photosensitive member, or between the brush fibers or the magnetic particles in consideration of the unavoidable space between the fibers or the magnetic particles.

Figure 5:
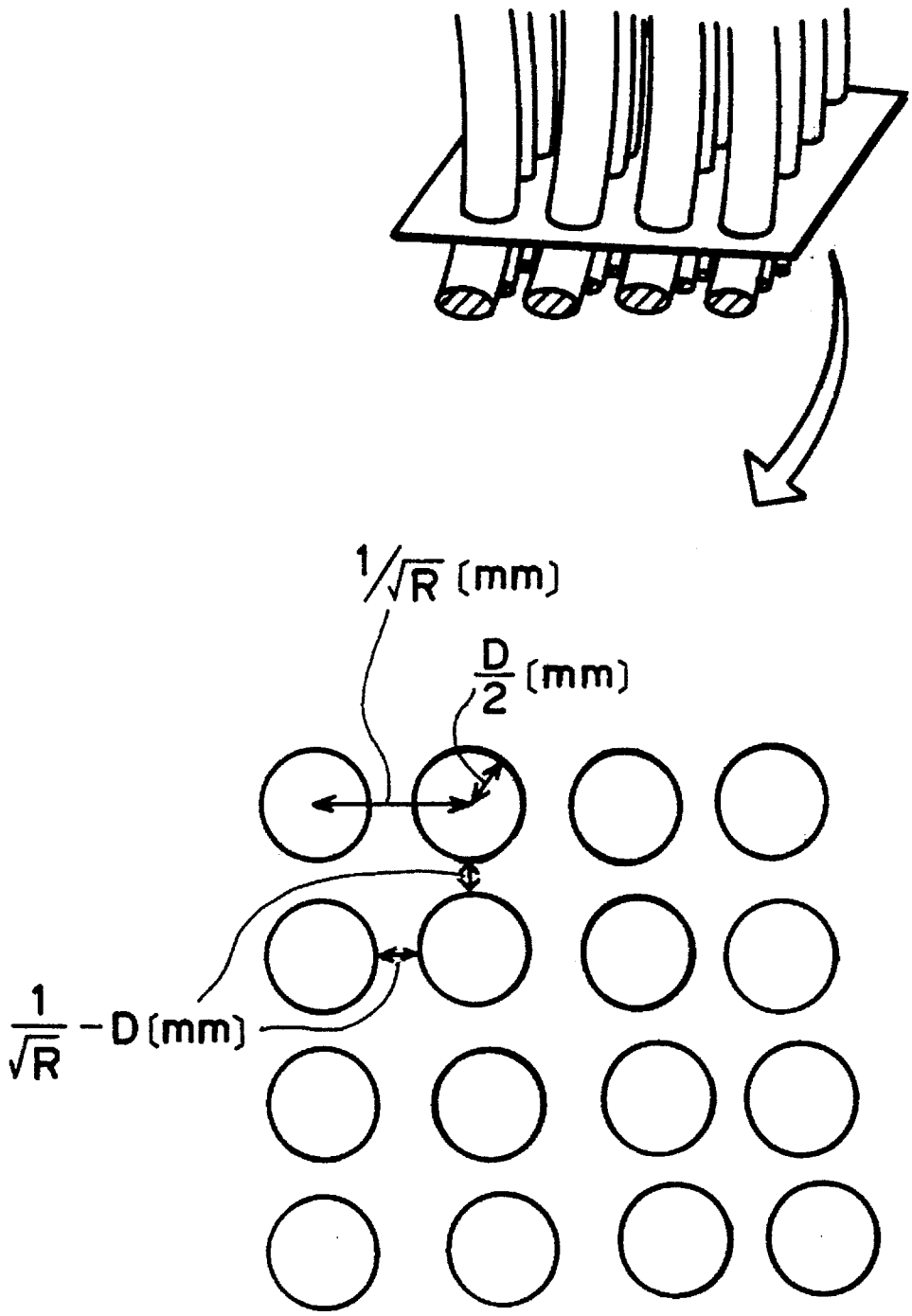
FIG. 5 is a sectional view illustrating distance between brushes.

Consideration will be made as to the space in the case of the charging member being a fur brush. FIG. 5 is a schematic drawing in which a 1 mm×1 mm area of the photosensitive member surface is shown. The fiber density is R (fibers/$mm^2$), and the diameter of the fiber is D. The distance between fibers when the fur brush is contacted to the photosensitive member theoretically is $1/\sqrt{R}-D$. Actually, the ends of the fibers are more randomly arranged and contacted, but this is a reasonable model when an average space in the entirety of the nip is considered.

With this static state the photosensitive member is not contacted to any fiber in the space between adjacent fibers, and therefore, another fiber or other fibers pass this area of the photosensitive member when it passes through the charging nip. To accomplish this, the nip width between the photosensitive member and the contact charging member is made large enough, or the nip width is effectively increased by increasing the peripheral speed difference.

When a given point on the photosensitive member is considered, a distance L in which the point is capable of being contacted to the charging member while it is passed through the charging nip can be expressed as:

$$L=N(Vk-Vb)/Vk$$

where N is the nip width, Vk is the peripheral speed of the photosensitive member, and Vb is the peripheral speed of the charging member. This means that a point on the photosensitive member is rubbed with the length L=N(Vk−Vb)/Vk on the outer periphery of the charging member. The larger the value L, the higher the probability of contact at a point with the charging member.

FIG. 3 shows a relationship between the peripheral speed ratio (Vk−Vb)/Vk and the charge potential of the photosensitive member. It is understood that the charge area of the photosensitive member increases, and the macroscopic converging property of the surface potential of the photosensitive member is increased, with an increase in the peripheral speed ratio.

From the foregoing investigations, it is understood that when the charging member is sparse (distances between adjacent fiber ends are large), the value L is to be large, but when the charging member is dense, the value L may be small.

When a comparison is made between a sparse fur brush and a dense magnetic brush, the magnetic brush is effective to provide uniform charging under the same peripheral speed ratio.

Figure 6:
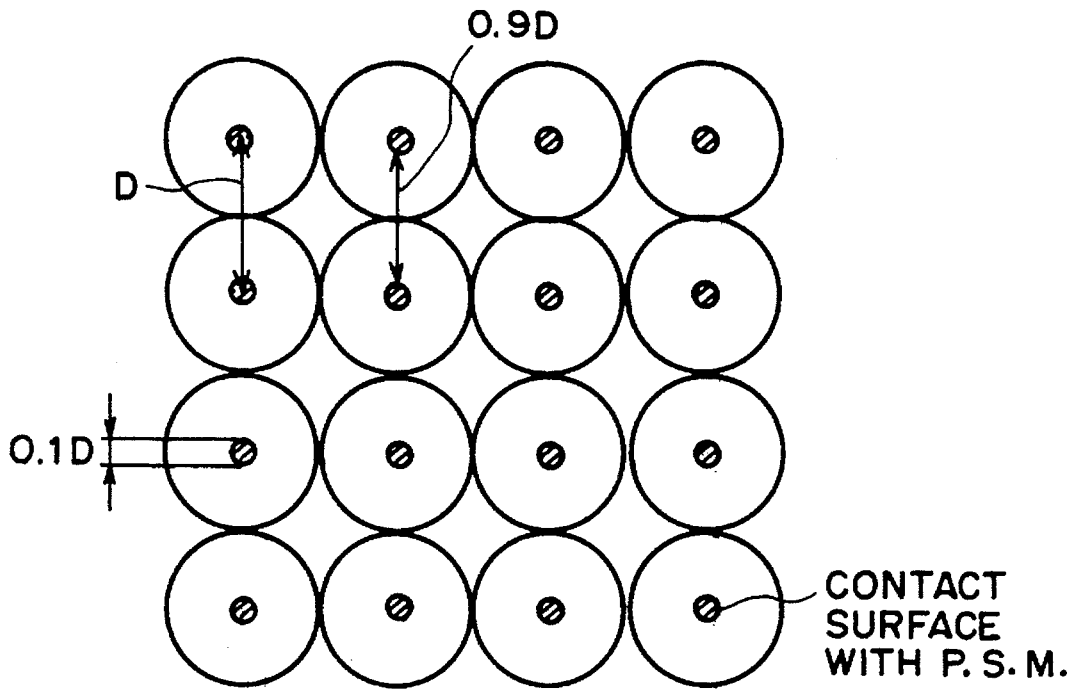
FIG. 6 is a sectional view illustrating a distance between electroconductive magnetic particles.

As an example, for a fur brush comprising 30μm-thick fibers and having a density of 160 fibers/$mm^2$, a contact nip of 2 mm is required with a peripheral speed ratio of 200% to provide sufficient charging. When magnetic particles having a particle diameter of 30 μm are used in the form of a magnetic brush, a nip having a width of approx. 1.1 mm is sufficient with the same peripheral speed ratio. This is because, as shown in FIG. 6, the spaces in the nip are smaller in the case of magnetic particles and, therefore, uniform charging is possible with a narrower nip width.

If the spacing is small, sufficiently uniform charging is possible even if the value L is small. If a sparse brush is used, the value L must be sufficiently large.

Various experiments have been carried out for the conditions necessary for sufficiently uniform charging.

The outside diameter of the brush, the process speed, the applied voltage or the like are the same as in the first embodiment. The brush used also was the same, having a resistance of $1\times10^5$ (conductive layer). The diameter of the fibers was 5, 30, 50, 250 μm, and the fiber density was 16, 160, 310, 775 (fibers $mm^2$). The minimum peripheral speed ratio required for uniform charging with a constant nip width of 2 mm was determined through experiments. The results are shown in Table 2.

TABLE 2

| BRUSH DENSITY | BRUSH THICKNESS [μm] | | | |
|---|---|---|---|---|
| [fibers/$mm^2$] | 5 | 30 | 100 | 250 |
| 16 | 980 | 880 | 600 | — |
| 160 | 280 | 200 | — | — |
| 310 | 200 | 110 | — | — |
| 775 | 125 | 24 | — | — |

(unit: %)

Figure 7:
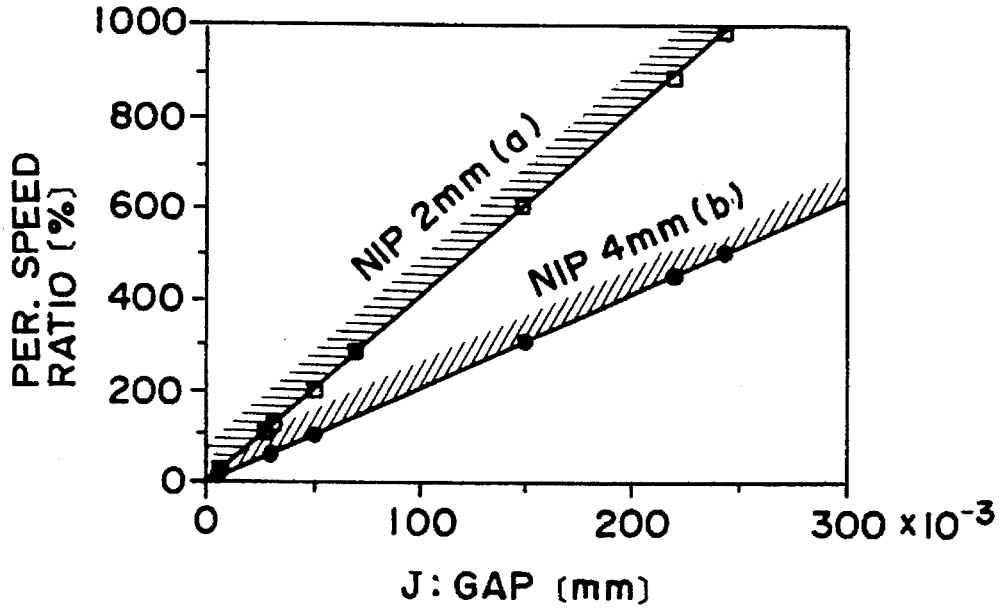
FIG. 7 is a graph illustrating peripheral speed ratio vs. gap between brushes.

In addition, the spacing between fibers is calculated from the fiber density and the thickness of the fibers. On the basis of the calculation described hereinbefore, the spacing is J=1/√R-D. The value J in the respective combinations and the peripheral speed ratios required for uniform charging are plotted on the graph in FIG. 7(*a*) (hatched portion). The same experiments were carried out with the contact nip width of 4 mm, and the results are as shown in Table 3. The relationship between the value J and the peripheral speed ratio, are plotted on the graph in FIG. 7(*b*) (hatched portion).

TABLE 3

| BRUSH DENSITY | BRUSH THICKNESS [μm] | | | |
|---|---|---|---|---|
| [fibers/mm$^2$] | 5 | 30 | 100 | 250 |
| 16 | 500 | 450 | 300 | — |
| 160 | 140 | 100 | — | — |
| 310 | 100 | 55 | — | — |
| 775 | 60 | 12 | — | — |
| | | | | (unit: %) |

From the foregoing, it has been found that there is a close relationship among the contact nip width, the peripheral speed ratio and the fiber to fiber distance, and satisfactory uniform charging is possible if kJ<N(Vk−Vb)/Vk is satisfied (J; mm: and N; mm). Here, k is a constant and is a factor determining the condition for uniform and Complete charging. From the experiments, k=80 is satisfactory to determine the driving condition of the charging member, irrespective of the density of the fibers of the brush and the thickness of the fibers.

The diameter of the brush is preferably 5–250 μm, and the fiber density is preferably 10–80 fibers/mm$^2$.

The images were produced with the printer of this embodiment having the structure described above. It has been confirmed that satisfactory images could be produced under any ambient conditions. The voltage applied to the charging member 2 was only −700 V corresponding to the charging potential. As contrasted to a conventional charging device, no additional voltage for excitation was necessary.

In addition, the production of ozone and the deterioration of the photosensitive member surface attributable to electric discharge have been eliminated.

Embodiment 2

This embodiment is characterized by the use of an electroconductive magnetic brush as the charging member 2.

As described in the first embodiment, charging by charge injection is possible to any member to be charged if the member to be charged has a charge injection layer 12 using low resistance particles 12*a*, and a sufficient charging period is given.

However, in order provide a sufficient converging property relative to the applied voltage (the potential provided by one passage through the charging nip results in a voltage of not less than 90% of the applied voltage), it is required to reduce the resistance of the magnetic brush particles. When charging is carried out using a magnetic brush of such a low resistance, current leakage is produced if the photosensitive member 1 has a pin hole, and in addition, the magnetic brush particles are deposited on the latent image on the photosensitive member.

This is because upon charging, electric charge is injected into conductive particles adjacent the ends of the brush through chains of conductive particles of the magnetic brush, and the magnetic brush particles are removed from the chains by coulomb force, with the result of depositing on the latent image.

The low resistance particles of the magnetic brush deposited on the photosensitive member may be mixed into the developing device in the developing zone with the result of improper developing action. In the transfer station, improper image transfer occurs in that portion. These problems may arise. In order to prevent this, it is required to increase the resistance of the magnetic brush particles. The inventor's investigations have revealed that this problem can be eased by using a magnetic brush constituted by particles having a resistance of not less than $1\times10^4\Omega$, preferably not less than $3\times10^4\Omega$.

Accordingly, in this embodiment, in order to achieve a satisfactory charging property, resistivity against pin hole leakage and suppression of deposition of the conductive particles from the magnetic brush, a photosensitive member 1 having a charge injection layer 12 is charged by an electroconductive magnetic brush having a resistivity of $3\times10^4\Omega$–$1\times10^7\Omega$.

Figure 8:
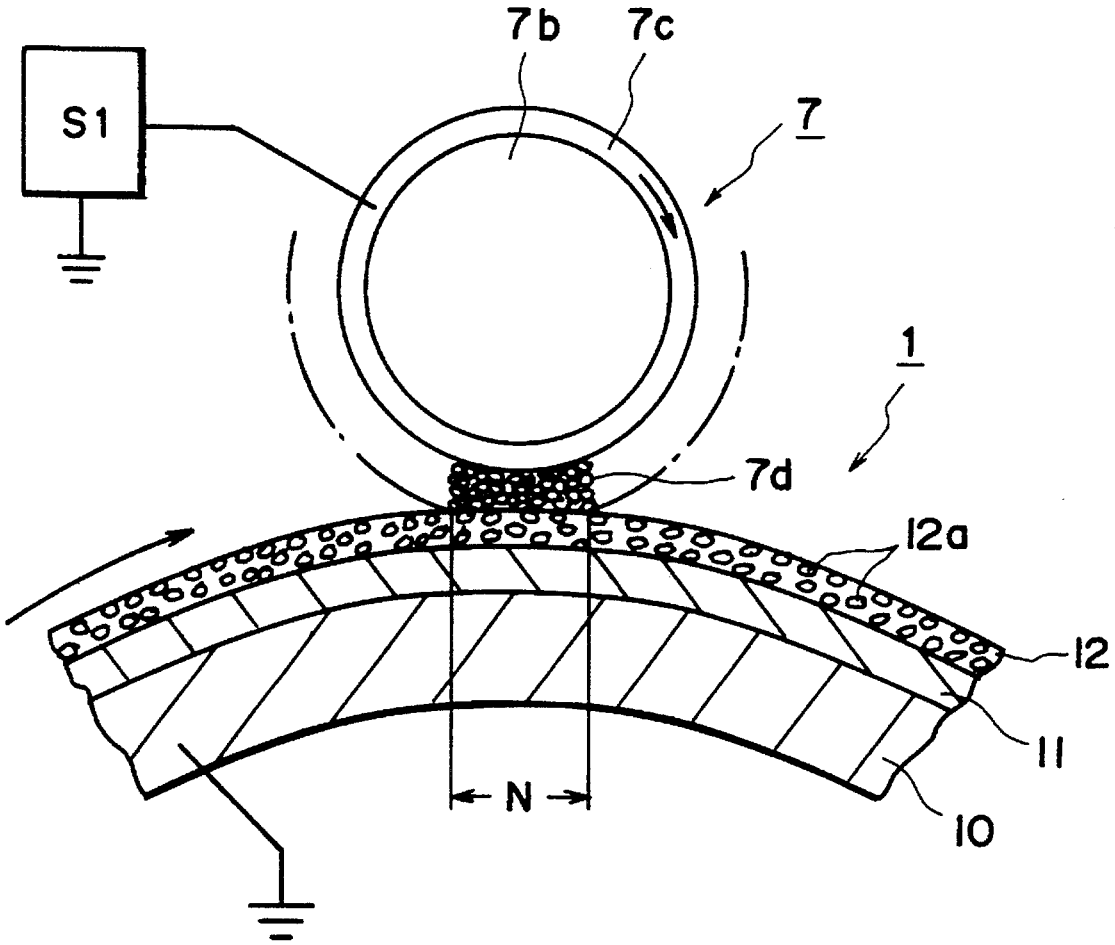
FIG. 8 is an enlarged view of a charging member in the form of a magnetic brush.

More particularly, an electrophotographic type printer as used in the first embodiment is used, and the charging brush 2 as the contact charging member is replaced with a conductive magnetic brush 7, as shown in FIG. 8, and various experiments have been carried out.

The conductive magnetic brush is formed by a non-magnetic electroconductive sleeve 7*c*, a magnet roll 7*b* contained therein and magnetic and electroconductive particles 7*d* on the sleeve. The magnet roll is stationary, and the surface of the sleeve is rotated so that its periphery is moved in the direction opposite to the peripheral movement direction of the photosensitive drum.

The resistance of the particles 7*d* is determined as a resistance when an aluminum drum is contacted to the magnetic brush, and a DC voltage of 100 V is applied, in the structure described above.

The magnetic and conductive particles 7*d* may be:

particles provided by kneading resin material and magnetic powder such as magnetite or the like and converting it into particles (electroconductive carbon or the like may be fixed for adjustment of the resistance);

particles produced by particles of sintered magnetite, ferrite (the resistance may be adjusted by deoxidation); or one of the above which is plated so as to have a proper resistance.

In this embodiment, the following resin carrier is used.

Polyethylene resin material is mixed with magnetite of 100 parts by weight, and they are kneaded and pulverized. The particle size is 30 μm, and the resistance is $1\times10^6\Omega$. The resistance is substantially the specific resistance of the magnetite itself. If a higher resistance is desired, then the content of the magnetite may be reduced. If a lower resistance is desired, then carbon black is added to the powder.

Such conductive particles are applied on a sleeve having a thickness of 1 mm to form a charging nip N having a width of approx. 2 mm between the particles and the photosensitive member. The sleeve is rotated at the same peripheral speed as the photosensitive member surface but in the opposite direction to accomplish uniform contact between the photosensitive member and the magnetic brush.

Without the peripheral speed difference between the magnetic brush and the photosensitive member, the magnetic brush itself does not have physical restoring force. Therefore, if the magnetic brush deviates by whirling or eccentricity of the photosensitive member, then the nip N of the magnetic brush is not assured, resulting in improper charging. For this reason, contact with a fresh magnetic brush is always necessary. For this purpose, the same speed but opposite direction is used to provide a safety margin. However, the magnetic brush contacts the photosensitive member in the form of fine particles. Therefore, the effective charging nip width N is larger than the charging brush 2 of the first embodiment. It has been confirmed that sufficient charging is possible with a peripheral speed difference ratio of approx. 0.1.

In a charging member using a magnetic brush constituted by particles, the photosensitive member can be charged with a charging efficiency of not less than 90% relative to the applied voltage, if N(Vk−Vb)/Vk is not less than 0.2 mm. The peripheral speed Vb of the magnetic brush is rw, where the w is an angular speed of the sleeve 7*c* and r is a distance from the rotational center of the magnetic brush to the surface of the photosensitive member which is contacted by the magnetic brush. When, however, the sleeve 7*c* is fixed, and the magnet 7*b* in the sleeve 7*c* is rotated, Vb is $rw_1$, where $w_1$ is an angular speed of the magnet 7*b*.

A description will be made as to the proper range of spacing or the distance between adjacent chains of the magnetic brush (charging member).

In order to accomplish uniform charging of the photosensitive member, it is desired that 100×(Vk−Vb)/Vk is not less than 110%.

In the case of a magnetic brush, the particles constituting the magnetic brush are packed substantially at the highest density at the surface of the photosensitive member. When the particle size is large, as shown in FIG. 6, the distance between adjacent particles is large, with the result that the interval between the contact points is longer. Similarly to the case of the fur brush of the first embodiment, some portions of the surface of the photosensitive member may not be contacted by the particles.

In the case of a magnetic brush, as shown in FIG. 6, the particles are most tightly packed at the surface of the photosensitive member. Actually, the states of the packing are random, and therefore, are not so regular as shown. However, when an average of the overall states is considered, the model shown is reasonable.

In this state, the distance between the centers of the adjacent particles is equal to the particle size D (mm). Actually, however, the contact between the particles and the photosensitive member occurs not at one point but in a certain range. In a region within approx. 10% of the particle size from the center of the particle, charging is effected by tunnel current or the like. Therefore, the effective gap between adjacent particles is approx. 0.9D.

Ferrite particles are subjected to deoxidation treatment to provide a volume resistivity of $1\times10^5$ Ωcm. Such magnetic particles are classified by meshes, and experiments have been carried out for the respective particle sizes. In the experiments, the contact nip width between the magnetic brush and the photosensitive member was fixed to be 2 mm, and the peripheral speed ratio between the photosensitive member and a brush capable of providing a satisfactory charging property, are determined through experiments. The following Table 4 shows the results of experiments.

TABLE 4

| PARTICLE SIZE (μm) | 10 | 20 | 30 | 50 | 100 |
|---|---|---|---|---|---|
| SPEED RATIO | 35% | 70% | 130% | 180% | 360% |

As will be understood, when the particle size is small, sufficient charging is possible even if the peripheral speed ratio is small, because the distance between particles is small. However, with an increase in particle size, the gap increases. In order to sufficiently charge the portion corresponding to the gap, the peripheral speed ratio of the magnetic brush is increased to increase the chance of rubbing any part of the photosensitive member with the brush, or the contact nip width is increased. From the above, satisfactory charging can be accomplished if kJ<N(Vk−Vb)/Vk is satisfied, where N is the nip width (mm), Vk is the peripheral speed of the photosensitive member, Vb is the peripheral speed of the charging member, D is the particle size, and J is the length of the gap (J=0.9D). It has been confirmed that k=80 in the case of the magnetic brush, similarly to the case of the fur brush.

Thus, also when a magnetic brush is used, uniform direct charge injection is possible by driving the charging member so as to satisfy 80J<N(Vk−Vb)/Vk.

The particle size of the magnetic particles is preferably 1–100 μm.

The particle size of the magnetic particles used in this invention are determined as an average particle size in the following manner.

The particle size distribution of the magnetic particles is first determined in the following manner:

(1) 100 g of the magnetic particles are measured to the order of 0.1 g.

(2) 100 mesh, 145 mesh, 200 mesh, 250 mesh, 350 mesh and 400 mesh standard sieves (hereinafter simply called sieves, are overlaid in this order from the top, and the set of sieves is placed on a saucer, and the magnetic particles are placed on the top sieve, and thereafter, the top is covered.

(3) A vibrating machine is used to revolve the set in a horizontal plane at 285±6 revolutions/minute and at 150±10 cycles/minute per 15 minutes.

(4) Thereafter, the magnetic particles on the respective sieves and saucers are measured to the order of 0.1 g.

(5) The weight percentages are calculated down to two decimal places, and the results are rounded to the first decimal place in accordance with JIS-Z8401.

The dimensions of the sieves are such that the inside diameter above each sieve plane is 200 mm, and the depth from the top to the sieve plane is 45 mm.

The total of the respective weights must not be 99% or less of the original total weight.

The average particle size is determined on the basis of the above-described particle size distribution, in accordance with the following equation:

Average particle size (μm)=1/100×((remainder on the 100% sieve)×140+(remainder on the 145 mesh sieve)×122+(remainder on the 200 mesh sieve)×90+(remainder on the 150 mesh sieve)×68+(remainder on the 350 mesh sieve)×52+(remainder on the 400 mesh sieve)×38+(particles on the saucer)×17)).

The amount of particles having the size of 500 mesh or less is calculated by placing 50 g magnetic particles on a 500 mesh standard sieve, under vacuum, and calculating the amount on the basis of weight reduction.

Using such a charging member, images produced by the printer shown in FIG. 1 are evaluated. It has been confirmed that after the photosensitive member passes through the charging nip once with application of a DC voltage of −700 V to the sleeve, the surface potential of the photosensitive member (originally 0 V) is charged to −680 V, and therefore, the charging property is satisfactory.

It has also been confirmed that no leakage occurs even if the photosensitive member has a pin hole, and that the conductive particles constituting the magnetic brush are not deposited on the photosensitive member. Therefore, satisfactory images are produced.

Embodiment 3

In this embodiment, an intermediate resistance material having an ion electroconductivity as the charge injection layer 12 on the surface of the photosensitive member is used. Contact charging is carried out on the photosensitive member, using the intermediate resistance charging brush 2 used in the first embodiment.

As for the charge injection layer 12, two alternatives are considered. The first is to use an insulative binder and conductive particles 12*a*, as in the first embodiment. The second is to use a material which itself has an intermediate resistance. In the first case, the charge (free electron) is applied to the conductive particles 12*a*. In this embodiment, however, use is made of an intermediate resistance material having an ion conductivity, and electric charge is injected to the trap level thereof.

A conventional OPC photosensitive member surface material has a resistance of not less than $10^{15}$ Ωcm (surface resistance), and therefore, a very small part can retain the electric charge adjacent the surface thereof. Therefore, in order to inject the electric charge into such a material, the charging member 2 is required to have a sufficiently low resistance, and the charging period is sufficiently long, by which the charge is trapped at deep levels.

For this reason, in order to inject electric charge using the intermediate charging member 2 as in this embodiment, it is necessary to use a material having a shallow trap level as the surface layer of the photosensitive member.

In this embodiment, the charge injection layer 12 is provided by mixing insulative acrylic resin and methoxymethyl nylon having an ion conductivity.

More particularly, the following is mixed in methanol solvent:

| | |
|---|---|
| Light-curing acrylic monomer | 100 parts |
| Methoxymethyl nylon (Toresin EF-30 (trade name)) | 10 parts |
| Photoinitiator | 5 parts |

The mixture is applied on the surface of an ordinary negatively chargeable OPC photosensitive member into a thickness of 3 μm, and is cured by ultraviolet rays, thus providing a charge injection layer 12.

As a result, the resistance of the material of the surface of the photosensitive member is decreased to $10^{11}$ Ωcm from a resistance of $10^{15}$ Ωcm or higher of the charge transfer layer constituting the surface of the ordinary OPC surface. Therefore, the charge injection property is significantly improved.

This is because shallow trap levels are provided in the methoxymethyl nylon. Therefore, sufficient charge injection is possible even by a contact charging member having a resistance of approx. $10^5$.

Using the photosensitive member 1 thus produced, images are formed by the printer of the electrophotographic type of the first embodiment. It has been confirmed that no flow of the image, or current leakage through a pin hole on the photosensitive drum occurs, and that after the photosensitive member passes through the charging nip N once with the application of −700 V voltage to the charging brush 2, the charged potential of −680 V can be provided. Therefore, a satisfactory charging operation is possible.

In this embodiment, by mixing the insulative resin material and the ion conductivity resin, the charge injection layer 12 is given an intermediate resistance. However, this does not limit the scope of the present invention, and the following alternative are usable:

(1) Single resin material of ion conductivity may be used;

(2) A functional group for giving the conductivity may be introduced into the insulative resin;

(3) Graphed coupling of the groove exhibiting conductivity may be used; and (4) The surface of the layer may be doped with an electroconductive material.

By adjusting the resistance of the charge injection layer 12 at the surface of the photosensitive member by these means to be $1\times10^{10}$–$1\times10^{14}$ Ωcm, a charging operation is possible with satisfactory potential converging property with the use of an intermediate resistance contact charging member 2.

While the invention has been described with reference to the structures disclosed herein, it is not confined to the details set forth and this application is intended to cover such modifications or changes as may come within the purposes of the improvements or the scope of the following claims.

What is claimed is:

1. A charging device comprising:

a movable member to be charged having a surface charge injection layer with a volume resistivity of $1\times10^{10}$–$1\times10^{14}$ Ωcm;

a charging member for charging said member to be charged, said charging member including a movable charging brush comprising fibers contactable with said member to be charged and supplied with a voltage; and wherein said movable member is driven such that the following relationship is satisfied:

$$N(Vk-Vb)/Vb>4,$$

where Vk (mm/sec) is a movement speed of the surface of said member to be charged, Vb (mm/sec) is a movement speed of an outer peripheral surface of said charging brush, and N (mm) is a contact width between said member to be charged and said charging brush, measured in a movement direction of said member to be charged.

2. A device according to claim 1, wherein said charge injection layer comprises an insulative binder and conductive fine particles dispersed therein.

3. A device according to claim 2, wherein the conductive fine particles are light-transmissive.

4. A device according to claim 2, wherein said conductive fine particles comprise $SnO_2$.

5. A device according to claim 1, wherein the following relationship is satisfied:

$$(1/\sqrt{R}-D)\times 80 < N(Vk-Vb)/Vk$$

where R (fibers/mm$^2$) is a fiber density of the charging brush, and D (mm) is a diameter of fibers of the charging brush.

6. A device according to claim 5, wherein the following is satisfied:

$$10 \leqq R \leqq 800$$

$$0.005 \leqq D \leqq 0.250.$$

7. A device according to claim 1, wherein said. charging member has a resistance of $1\times10^4$–$1\times10^7$Ω.

8. A device according to claim 1, wherein the voltage is a DC voltage.

9. A process cartridge detachably mountable to an image forming apparatus, comprising:

a movable member to be charged having a surface charge injection layer with a volume resistivity of $1\times10^{10}$–$1\times10^{14}$ Ωcm, said surface layer being capable of bearing an image;

a charging member for charging said member to be charged, said charging member including a movable charging brush comprising fibers contactable with said member to be charged and supplied with a voltage; and wherein said movable member is driven such that the following relationship is satisfied:

$$N(Vk-Vb)/Vk>4,$$

where Vk (mm/sec) is a movement speed of the surface of said member to be charged, Vb (mm/sec) is a movement speed of an outer peripheral surface of said charging brush, and N (mm) is a contact width between said member to be charged and said charging brush, measured in a movement direction of said member to be charged.

10. A process cartridge according to claim 9, further comprising a developing device for developing the member to be charged with toner.

11. A process cartridge according to claim 9 or 10, wherein the following is satisfied:

$$(1/\sqrt{R}-D)\times 80<N(Vk-Vb)/Vk$$

where R (fibers/mm$^2$) is a fiber density of the charging brush, and D (mm) is a diameter of fibers of the charging brush.

12. An image forming apparatus comprising:

a movable member to be charged having a surface charge injection layer with a volume resistivity of $1\times10^{10}$–$1\times10^{14}$ Ωcm, said surface layer being capable of bearing an image;

a charging member for charging said member to be charged, said charging member inducing a movable charging brush comprising fibers contactable with said member to be charged and supplied with a voltage; and image forming means for forming an image on said surface layer;

wherein said movable member is driven such that the following relationship is satisfied:

$$N(Vk-Vb)/Vk>4,$$

where Vk (mm/sec) is a movement speed of the surface of said member to be charged, Vb (mm/sec) is a movement speed of an outer peripheral surface of said charging brush, and N (mm) is a contact width between said member to be charged and said charging brush, measured in a movement direction of said member to be charged.

13. An apparatus according to claim 12, wherein said charging brush comprises fibers and the following is satisfied:

$$(1/\sqrt{R}-D)\times 80<N(Vk-Vb)/Vk$$

where R (fibers/mm$^2$) is a fiber density of the charging brush, and D (mm) is a diameter of fibers of the charging brush.

14. An apparatus according to claim 12, wherein said member to be charged comprises an organic photoconductive layer.

15. A charging device comprising:

a movable member to be charged having a surface charge injection layer with a volume resistivity of $1\times10^{10}$–$1\times10^{14}$ Ωcm;

a charging member for charging said member to be charged, said charging member including a movable conductive particle layer contactable with said member to be charged and supplied with a voltage; and wherein said movable member is driven such that the following relationship is satisfied:

$$N(Vk-Vb)/Vk>0.2$$

where Vk (mm/sec) is a movement speed of the surface of said member to be charged, Vb (mm/sec) is a movement speed of an outer peripheral surface of said conductive particle layer, and N (mm) is a contact width between said member to be charged and said conductive particle layer, measured in a movement direction of said member to be charged.

16. A device according to claim 15, wherein said charge injection layer comprises an insulative binder and conductive fine particles dispersed therein.

17. A device according to claim 16, wherein the conductive fine particles are light-transmissive.

18. A device according to claim 16, wherein said conductive fine particles comprise $SnO_2$.

19. A device according to claim 15, wherein the following is satisfied:

$$0.9\times D\times 80<N(Vk-Vb)/Vk$$

where D (mm) is a particle size of conductive particles of said conductive particle layer.

20. A device according to claim 19, wherein $0.001\leqq D\leqq 0.1$.

21. A device according to claim 15 or 19, wherein conductive particles of said conductive particle layer are magnetic.

22. A device according to claim 15, wherein said charging member has a resistance of $1\times10^{4}$–$1\times10^{7}$Ω.

23. A device according to claim 15, wherein the voltage is a DC voltage.

24. A process cartridge detachably mountable to an image forming apparatus comprising:

a movable member to be charged having a surface charge injection layer with a volume resistivity of $1\times10^{10}$–$1\times10^{14}$ Ωcm, said surface layer being capable of bearing an image;

a charging member for charging said member to be charged, said charging member including a movable conductive particle layer contactable with said member to be charged and supplied with a voltage; and wherein said movable member is driven such that the following relationship is satisfied:

$$N(Vk-Vb)/Vk>0.2$$

where Vk (mm/sec) is a movement speed of the surface of said member to be charged, Vb (mm/sec) is a movement speed of an outer peripheral surface of said conductive particle layer, and N (mm) is a contact width between said member to be charged and said conductive particle layer, measured in a movement direction of said member to be charged.

25. A process cartridge according to claim 24, further comprising a developing device for developing said member to be charged with toner.

26. A process cartridge according to claim 24 or 25, wherein the following is satisfied:

$$0.9\times D\times 80<N(Vk-Vb)/Vk$$

where D (mm) is a particle size of conductive particles of said conductive particle layer.

27. An image forming apparatus comprising:

a movable member to be charged having a surface charge injection layer with a volume resistivity of $1\times10^{10}$–$1\times10^{14}$ Ωcm, said surface layer being capable of bearing an image;

a charging member for charging said member to be charged, said charging member including a movable conductive particle layer contactable with said member to be charged and supplied with a voltage; and wherein said movable member is driven such that the following relationship is satisfied:

$$N(Vk-Vb)/Vk>0.2$$

where Vk (mm/sec) is a movement speed of the surface of said member to be charged, Vb (mm/sec) is a movement speed of an outer peripheral surface of said conductive particle layer, and N (mm) is a contact width between said member to be charged and said conductive particle layer, measured in a movement direction of said member to be charged.

28. An image forming apparatus according to claim 27, wherein the following is satisfied:

$$0.9\times D\times 80<N(Vk-Vb)/Vk$$

where D (mm) is a particle size of conductive particles of said conductive particle layer.

29. An apparatus according to claim 27, wherein said member to be charged comprises an organic photoconductor.

30. A charging device comprising:

a movable member to be charged;

a charging member for charging said member to be charged, said charging member including a movable charging brush comprising fibers contactable with said member to be charged and supplied with a voltage; and wherein said movable member is driven such that the following relationship is satisfied:

$$N(Vk-Vb)/Vk>4,$$

where Vk (mm/sec) is a movement speed of the surface of said member to be charged, Vb (mm/sec) is a movement speed of an outer peripheral surface of said charging brush, and N (mm) is a contact width between said member to be charged and said charging brush, measured in a movement direction of said member to be charged.

31. A device according to claim 30, wherein the following is satisfied:

$$(1/\sqrt{R}-D)\times 80<N(Vk-Vb)/Vk$$

where R (fibers/mm$^2$) is a fiber density of the charging brush, and D (mm) is a diameter of fibers of the charging brush.

32. A device according to claim 31, wherein the following is satisfied:

$$10\leqq R\leqq 800$$

$$0.005\leqq D\leqq 0.250.$$

33. A device according to claim 30, wherein said charging member has a resistance of $1\times10^4$–$1\times10^7$Ω.

34. A device according to claim 30, wherein the voltage is a DC voltage.

35. A device according to claim 30, wherein the member to be charged is provided with a photosensitive member.

36. A process cartridge detachably mountable to an image forming apparatus, comprising:

a movable member to be charged, said member to be charged being capable of bearing an image;

a charging member for charging said member to be charged, said charging member including a movable charging brush comprising fibers contactable with said member to be charged and supplied with a voltage; and wherein said movable member is driven such that the following relationship is satisfied:

$$N(Vk-Vb)/Vk>4,$$

where Vk (mm/sec) is a movement speed of the surface of said member to be charged, Vb (mm/sec) is a movement speed of an outer peripheral surface of said charging brush, and N (mm) is a contact width between said member to be charged and said charging brush, measured in a movement direction of said member to be charged.

37. A process cartridge according to claim 36, further comprising a developing device for developing the member to be charged with toner.

38. A process cartridge according to claim 36 or 37, wherein the following is satisfied:

$$(1/\sqrt{R}-D)\times 80<N(Vk-Vb)/Vk$$

where R (fibers/mm$^2$) is a fiber density of the charging brush, and D (mm) is a diameter of fibers of the charging brush.

39. A process cartridge according to claim 36, wherein the member to be charged is provided with a photosensitive member.

40. A charging device comprising:

a movable member to be charged;

a charging member for charging said member to be charged, said charging member including a movable conductive particle layer contactable with said member to be charged and supplied with a voltage; and wherein said movable member is driven such that the following relationship is satisfied:

$$N(Vk-Vb)/Vk>0.2$$

where Vk (mm/sec) is a movement speed of the surface of said member to be charged, Vb (mm/sec) is a movement speed of an outer peripheral surface of said conductive particle layer, and N (mm) is a contact width between said member to be charged and said conductive particle layer, measured in a movement direction of said member to be charged.

41. A device according to claim 40, wherein the following is satisfied:

$$0.9\times D\times 80<N(Vk-Vb)/Vk$$

where D (mm) is a particle size of conductive particles of said conductive particle layer.

42. A device according to claim 41, wherein $0.001\leqq D\leqq 0.1$.

43. A device according to claim 40 or 41, wherein the conductive particles are magnetic.

44. A device according to claim 40, wherein said charging member has a resistance of $1\times10^4$–$1\times10^7$Ω.

45. A device according to claim 40, wherein the voltage is a DC voltage.

46. A device according to claim 40, wherein the member to be charged is provided with a photosensitive member.

47. A process cartridge detachably mountable to an image forming apparatus comprising:

a movable member to be charged, said member to be charged being capable of bearing an image;

a charging member for charging said member to be charged, said charging member including a movable conductive particle layer contactable with said member to be charged and supplied with a voltage; and wherein said movable member is driven such that the following relationship is satisfied:

$$N(Vk-Vb)/Vk>0.2$$

where Vk (mm/sec) is a movement speed of the surface of said member to be charged, Vb (mm/sec) is a movement speed of an outer peripheral surface of said conductive particle layer, and N (m/n) is a contact width between said member to be charged and said conductive particle layer, measured in a movement direction of said member to be charged.

48. A process cartridge according to claim 47, further comprising a developing device for developing said member to be charged with toner.

49. A process cartridge according to claim 47 or 48, wherein the following is satisfied:

$$0.9\times D\times 80<N(Vk-Vb)/Vk$$

where D (mm) is a particle size of conductive particles of said conductive particle layer.

50. A process cartridge according to claim 47, wherein the member to be charged is provided with a photosensitive member.

* * * * *

UNITED STATES PATENT AND TRADEMARK OFFICE

CERTIFICATE OF CORRECTION

PATENT NO. : 5,606,401

DATED : February 25, 1997

INVENTOR(S) : HIDEYUKI YANO

It is certified that error appears in the above-indentified patent and that said Letters Patent is hereby corrected as shown below:

At [57] ABSTRACT:

Line 8, "satisfied," should read --satisfied:--.

COLUMN 1:

Line 23, "imagebearing" should read --image bearing--.

COLUMN 2:

Line 16, "is" should read --in--.

COLUMN 11:

Line 25, "Complete" should read --complete--.

COLUMN 15:

Line 63, "alternative" should read --alternatives--.

COLUMN 16:

Line 26, "N(Vk-Vb)/Vb>4," should read --N(Vk-Vb)/Vk>4,--.

UNITED STATES PATENT AND TRADEMARK OFFICE

CERTIFICATE OF CORRECTION

PATENT NO. : 5,606,401 Page 2 of 2

DATED : February 25, 1997

INVENTOR(S) : HIDEYUKI YANO

It is certified that error appears in the above-identified patent and that said Letters Patent is hereby corrected as shown below:

COLUMN 21:

Line 17, "N(m/n)" should read --N(mm)--.

Signed and Sealed this

Sixteenth Day of September, 1997

*Attest:*

Bruce Lehman

BRUCE LEHMAN

*Attesting Officer*

*Commissioner of Patents and Trademarks*